US006746106B1

(12) United States Patent
Hager

(10) Patent No.: US 6,746,106 B1
(45) Date of Patent: Jun. 8, 2004

(54) FLUID EJECTION DEVICE

(75) Inventor: Michael B. Hager, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/356,215

(22) Filed: Jan. 30, 2003

(51) Int. Cl.[7] ..... B41J 2/05

(52) U.S. Cl. ..... 347/63; 347/65; 347/67; 347/47

(58) Field of Search ..... 347/63, 65, 67, 347/47; 216/27

(56) References Cited

U.S. PATENT DOCUMENTS

| | | | | |
|---|---|---|---|---|
| 5,441,593 A | * | 8/1995 | Baughman et al. | 216/27 |
| 5,658,471 A | | 8/1997 | Murthy et al. | |
| 5,988,786 A | | 11/1999 | Waller et al. | |
| 6,132,034 A | * | 10/2000 | Miller | 347/65 |
| 6,158,843 A | | 12/2000 | Murthy et al. | |
| 6,231,168 B1 | | 5/2001 | Maze et al. | |
| 6,238,269 B1 | | 5/2001 | Pollard et al. | |
| 6,309,054 B1 | | 10/2001 | Kawamura et al. | |
| 6,331,055 B1 | | 12/2001 | Miller et al. | |
| 6,364,467 B1 | | 4/2002 | Blair et al. | |
| 6,409,318 B1 | | 6/2002 | Clark | |
| 6,499,835 B1 | * | 12/2002 | Chee et al. | 347/63 |
| 6,557,983 B1 | * | 5/2003 | Inoue | 347/65 |
| 6,641,745 B2 | * | 11/2003 | Tan et al. | 216/27 |

FOREIGN PATENT DOCUMENTS

| | | |
|---|---|---|
| EP | 0842776 A2 | 5/1998 |
| EP | 921001 A1 | 6/1999 |

* cited by examiner

*Primary Examiner*—Hai Pham
*Assistant Examiner*—Lam S Nguyen

(57) ABSTRACT

Fluid ejection device includes a substrate having a top surface and a bottom surface. A plurality of fluid drop generators are formed on the top surface of the substrate along a shelf region, each including a firing chamber. A fluid feed slot structure is defined in the substrate, and has a side wall. A plurality of features formed in the side wall creates at least one diverging channel directed away from the shelf region.

25 Claims, 5 Drawing Sheets

FLUID EJECTION DEVICE

BACKGROUND OF THE DISCLOSURE

Various fluid ejection device arrangements, such as inkjet printheads, are known in the art and include thermally actuated drop ejection elements, which use resistive elements or the like to achieve fluid expulsion. For example, a representative thermal inkjet printhead has a plurality of thin film resistors provided on a substrate, e.g. a silicon substrate. A nozzle plate and barrier layer are provided on the substrate and define the firing chambers about each of the resistors. Alternatively, the nozzle plate and barrier layer are combined in a single layer. Flow of a current or a "fire signal" through a resistor causes fluid, e.g., ink, in the corresponding firing chamber to be heated and expelled through the appropriate nozzle.

Fluid is typically delivered to the firing chamber through a feed slot that is machined in the substrate. The substrate usually has a rectangular shape, with the slot disposed therein. Resistors are typically arranged in rows located on both sides of the slot. In an inkjet printhead, the width of the print swath achieved by one pass of a printhead is approximately equal to the length of the resistor rows, which in turn is approximately equal to the length of the slot.

The feed slot tends to reduce the substrate strength, leading to increased die chipping and cracking defects. Also, air bubbles can collect and grow in the feed slot, leading to fluid flow issues and nozzle starvation.

DETAILED DESCRIPTION OF THE DISCLOSURE

Figure 1:
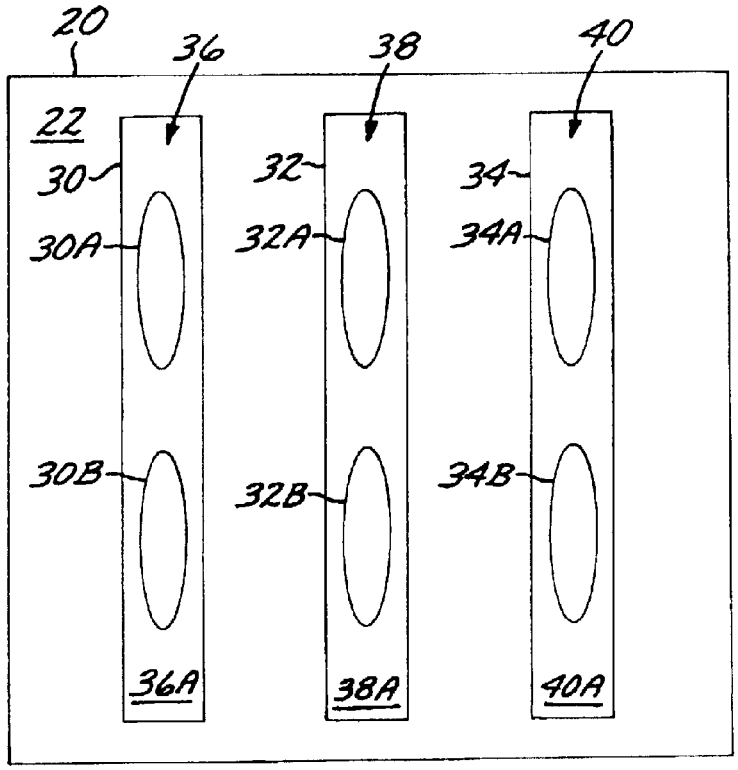
FIG. 1 schematically shows an embodiment of a fluid ejector substrate die, having a top surface and partial drill slot areas.

In the following detailed description and in the several figures of the drawing, like elements are identified with like reference numerals.

FIG. 1 schematically shows a printhead substrate die 20, having a top surface 22. In an exemplary embodiment, the substrate die is fabricated from silicon, although other materials can be employed. Various thin film layers are typically fabricated on the top surface to form a plurality of fluid drop generator elements comprising the printhead, and a barrier layer and/or an orifice layer are formed on the thin film layers, but for clarity these structures are not shown in FIG. 1. In order to supply fluid from the back side of the substrate die to the drop generators on the top surface, one or more fluid feed slots are formed in the die. Typically the feed slots are defined along a continuous, longitudinal extent of the drop generator columns. Continuous longitudinal feed slot areas 30, 32, 34 are depicted in FIG. 1. In one embodiment, continuous feed slot areas tend to weaken the substrate, since the substrate material is removed within the rectangular areas depicted as 30, 32, 34.

To reduce the weakening of the substrate due to formation of the feed slots, partial feed slots are employed. An exemplary arrangement of partial feed slots is depicted in FIG. 1, and includes partial feed slot areas 30A–30B, 32A–32B and 34A–34B. Thus, instead of forming a continuous feed slot area as represented by rectangular areas 30, 32, 34, partial feed slots are formed, with substrate areas between the partial slots remaining to reduce substrate weakening. While FIG. 1 shows three feed slot areas each with two partial feed slots formed therein, it will be appreciated that fewer or greater numbers of feed slot areas can be employed, each with a plurality of partial feed slots.

In the exemplary embodiment shown in FIG. 1, the top surface 22 of the substrate 20 is etched within the longitudinal feed slot areas to form rectangular trenches 36, 38, 40, each trench etched to a depth of 10 to 50 microns. The respective trenches have bottom surfaces 36A, 38A, 40A which are defined from the substrate. The trenches can provide fluid reservoir areas for fluid to be supplied to the drop generators. In one embodiment, surfaces 36A, 38A, 40A are substantially flat. Flat surfaces such as the trench bottom surf tend to collect and grow air bubbles on the surfaces. The air bubbles can impede or block fluid flow from the feed slots into the drop generators.

Figure 2:
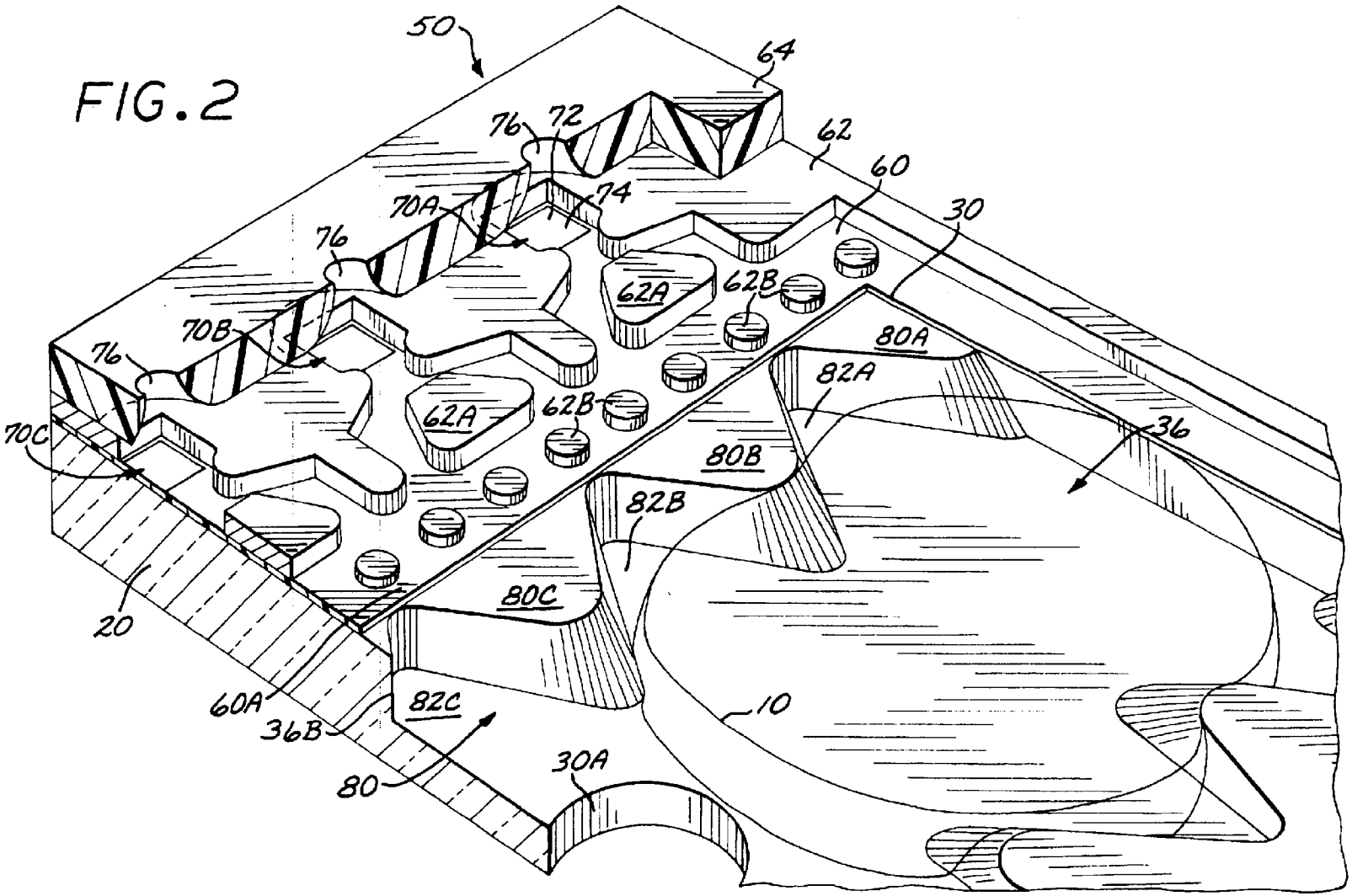
FIG. 2 is an isometric cutaway view of a fragment of an embodiment of a fluid ejector structure which employs partial drill slots as in the embodiment of FIG. 1.

The embodiment of FIG. 2 is an isometric cutaway view of a fragment of a printhead structure 50 which employs partial drill slots as described above regarding FIG. 1. In this embodiment, the substrate 20 has formed on its top surface a thin film structure 60, a barrier layer 62 and an orifice layer 64. A plurality of drop generators, including 70A, 70B, 70C, are defined on the substrate. Each drop generator includes a firing resistor such as resistor 72 formed in the thin film structure 60, a firing chamber such as chamber 74 defined in the barrier layer, and a nozzle such as nozzle 76 formed in the orifice layer 64. In this embodiment, barrier islands 62A defined by the patterned barrier layer are positioned in fluid flow channels adjacent the entrance to each chamber. In this embodiment, a barrier island reef 62B is also formed by the barrier layer on the fluidic shelf defined by the thin film layer structure adjacent a longitudinal edge of the feed slot area.

A slot area 30 is defined by an opening in the thin film layer structure in this embodiment. A trench 36 is etched in the substrate 20, defining a trench bottom surface 36A (see the embodiment of FIG. 1). A portion of a partial feed slot 30A is visible in FIG. 2. To alleviate the problem of air bubbles collecting in the trench, a set 80 of bubble trapping features is formed in the side wall 36B of the trench 36 adjacent the drop generators. In this embodiment, these features are tapered to create diverging alternate fluid flow channels directed away from the fluidic shelf. In this embodiment, the set of features includes projections 80A, 80B, 80C, which are tapered, sawtooth-like or serration-like features. The features 80 create passageways, such as channels 82A, 82B, 82C, whose walls diverge outwardly away from the fluidic shelf. It will be appreciated that the orifice layer 64 will cover the trench 36 when the printhead structure is completed. The features 80 in one exemplary embodiment are formed by mask features, described more fully below, on the order of about 90 μm by 90 μm, i.e. 90 μm in a direction along the fluidic shelf and 90 μm in a direction extending from the shelf out into the trench. After undercutting/rounding occurring as a result of the etching process, the width of the tips of the features is on the order of 50 μm. For this embodiment, the feature size is related to the pitch of the firing chambers. The width of the alternate fluid flow channels will depend on the length of the features. The features for exemplary designs will be sized in dependence on the ink flux feeding the number of nozzles in the region around the flat trench bottom, typically in the length range, extending from the shelf out into the trench, of about 20 μm to about 150 μm.

In one exemplary embodiment, the trench 36 is 300 μm wide by 5700 μm long. The partial slotting for this exemplary embodiment used two 300 μm by 1500 μm slots, providing an approximately 50% reduction in slot area. The minimum part slot size would be determined by the ink flux demands for any given design. There is a tradeoff between partial slot size and die strength. For typical partial slot sizes in the range of 50% to 75% (of a full slot area), a 50% partial slot size provides greater die strength than a 75% partial slot size. The die strength improvement using partial slots is typically a function of total die and slot areas.

In operation, fluid flows from a reservoir or supply below the substrate through the partial feed slots such as 30A into the trench 36. From the trench fluid flows over the fluidic shelf 60A past the barrier island reef into the respective firing chambers of the drop generators. As the drop generators are selectively energized, drops are emitted through the nozzles, and fluid flows into the chambers to replenish the fluid ejected through the nozzles. Air bubbles which form in the trench, or which flow through the slot into the trench under the forces of fluid motion, are substantially prevented from entering the firing chamber areas by the small passageways formed by the barrier reef islands. In one embodiment, over time, the bubbles, e.g. bubble 10, will grow, and will be forced away from the shelf by the geometry of the features 80. This in turn allows fluid to flow from the slot or trench areas to the fluidic shelf via the alternate passageways formed by the structures 80A, 80B, . . . and channels 82A, 82B . . . In one embodiment, without the features 80, the bubbles would eventually be trapped against the fluidic shelf, curtailing or cutting off fluid flow, to starve one or more of the drop generators, reducing print quality from the printhead structure 50. It is noted that the bubbles in the trench will typically grow to extend between the trench bottom surface and the undersurface of the orifice layer 64.

Figure 3:
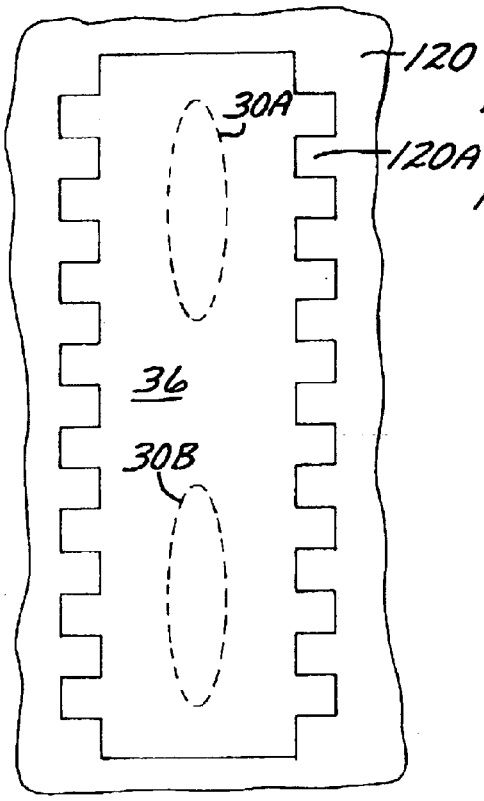
FIG. 3 shows an exemplary hard mask formed on the top surface of the substrate to define the pattern of an exemplary topside trench and bubble trapping features using a wet etch process.

The slot area trenches and bubble trapping features can be formed with wet or dry etch processes. A hard mask is used in one embodiment for the wet etch process, as shown in FIG. 3. The wet etch process involves subjecting the exposed substrate, in this example a silicon substrate, to TMAH (tetramethyl ammonium hydroxide) which anisotropically etches the silicon. The hard mask can be a field oxide (FOX) layer, for example. FIG. 3 shows an exemplary hard mask 120 formed on the top surface of the substrate by use of photolithographic techniques and patterned photoresist to define the FOX layer pattern. The FOX layer includes mask features, such as feature 120A, which overlay the bubble trapping features to be formed, and define the trench outline. The mask features have outside corners, i.e. open corners where the angles are greater than 90 degrees. In one embodiment, the mask features can be square, since tapered features will result from an anisotropic wet etch. The outside corners of the mask features and the anisotropic nature of the TMAH etch process result in tapered substrate features, creating diverging channels directed away from the fluidic shelf. After the hard mask is formed, the wet etch process is performed to form the trench, such as trench 36. The process parameters are controlled so that a desired trench depth is obtained. In one embodiment, some undercutting of the substrate beneath the hard mask edges will occur, and the process parameters are selected so that the amount of undercutting does not adversely affect the strength of the substrate. Typical process parameters include the length of time that the wet etchant is applied to the substrate and the silicon concentration of the wet etchant. The hard mask can remain over the bubble trapping features, or be removed by subsequent processing. Alternate wet etch processes can be used instead of TMAH; e.g., KOH (potassium hydroxide) can also be used to etch silicon.

Figure 4:
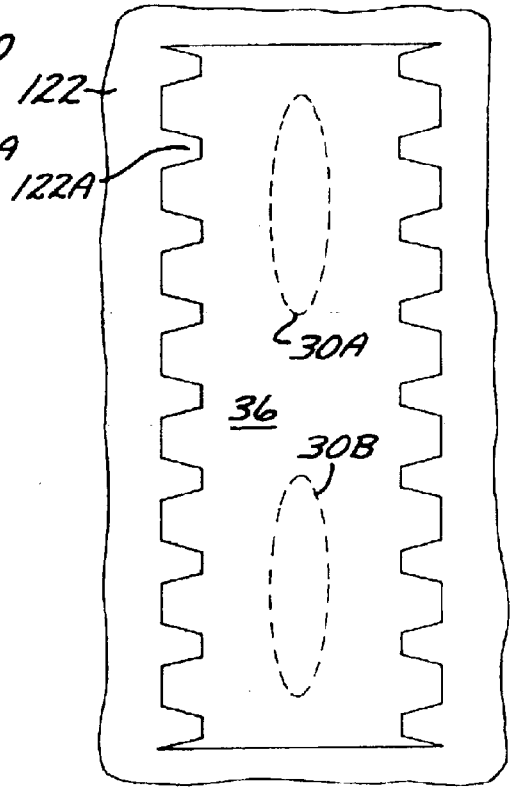
FIG. 4 shows an exemplary mask formed on the top surface of the substrate to define the pattern of an exemplary topside trench and bubble trapping features using a dry etch process.

The trench and bubble trapping features can also be formed by dry etch processes. In this case, the mask features which define the bubble trapping features are tapered, to create the tapered features that will result from isotropic silicon dry etching. FIG. 4 illustrates an exemplary embodiment of a mask 122 which can be used to form the trench and bubble trapping features. The mask 122 can be formed of FOX, or another patterned layer, e.g. photoresist. The mask includes tapered mask features such as features 122A to define the bubble trapping features. For example, the mask features can have tips which are generally trapezoidal or triangular in shape. Dry etching the silicon substrate can be done with a Deep Reactive Ion Etch (DRIE) process that involves alternating etch and deposition steps. This is a bias assisted ion bombardment process with protective polymer deposition including two main steps in one embodiment. First, an ionic etch is done using $SF_6$ for 5–10 seconds. Second, a $C_4F_8$ deposition is done to passivate the exposed silicon surfaces for approximately 5 seconds. These two steps are repeated until a final depth is reached. There are many variants of dry etchant processes known to those skilled in the art which can alternately be employed.

Figure 5:
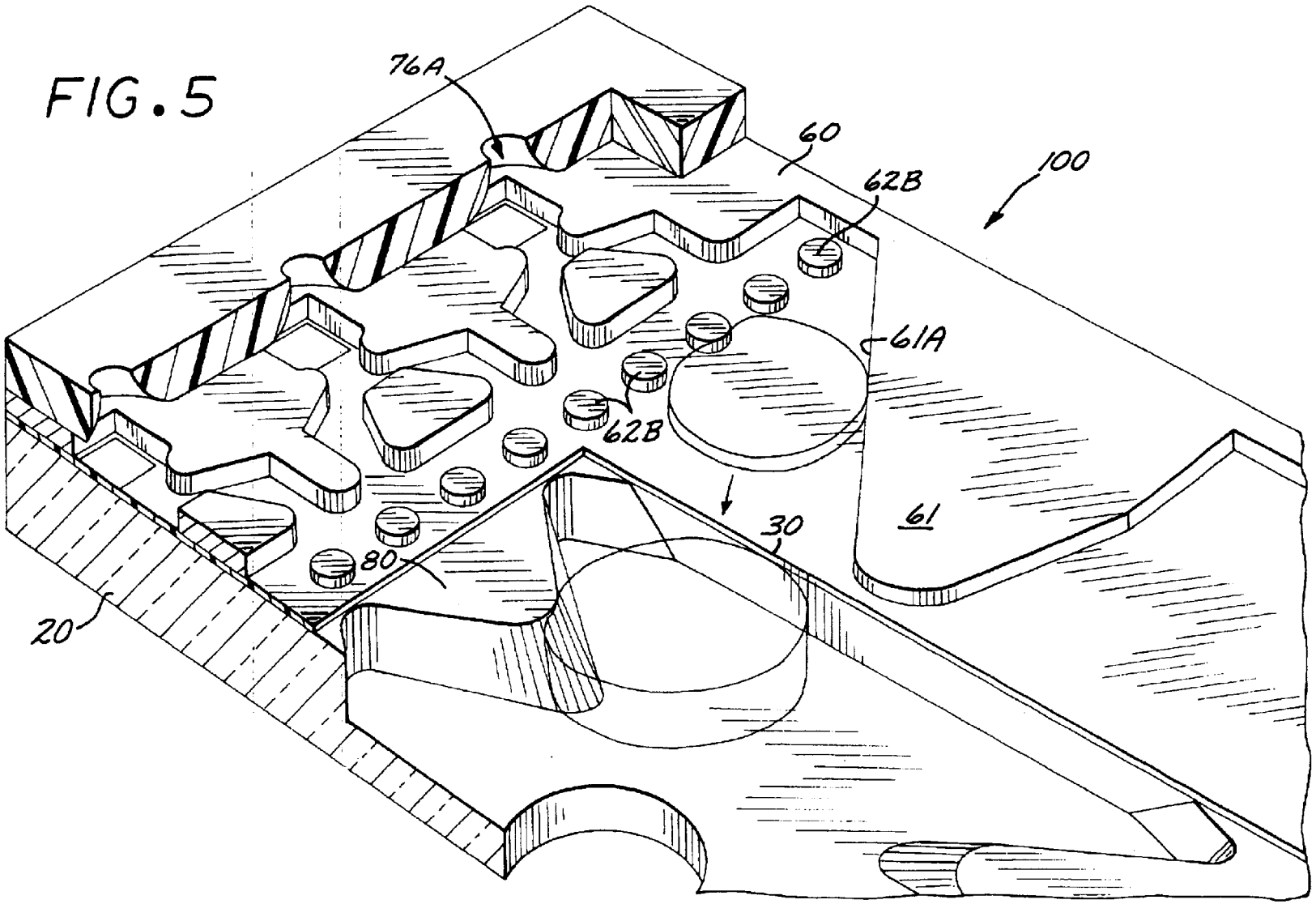
FIG. 5 shows a partial fragmentary isometric view of an alternate embodiment of a fluid ejector structure.

FIG. 5 shows a partial fragmentary isometric view of an alternate embodiment of a printhead structure 100 in accordance with an aspect of the invention. This embodiment is similar to that of FIG. 2, but has at least one drop generator 76A positioned beyond the end or lateral edge 31 of the trench 30. To alleviate the problem of fluid starvation to the drop generators positioned beyond the trench end due to bubble formation, a barrier layer feature 61 is formed in barrier layer 60. The feature 61 has an edge 61A which defines an acute angle with a line of the barrier reef islands 62B. The formation of this acute angle creates a divergent fluid pathway from the last drop generator. In one embodiment, due to features 61, air bubbles that may form on the flat surface of the substrate 30 will move towards the trench 36. Once the bubble has moved into this area, it will become trapped by features 80. Thus, the feature 61A and the barrier reef islands form a bubble trap which can hold and move air bubbles away from the drop generators.

Figure 6:
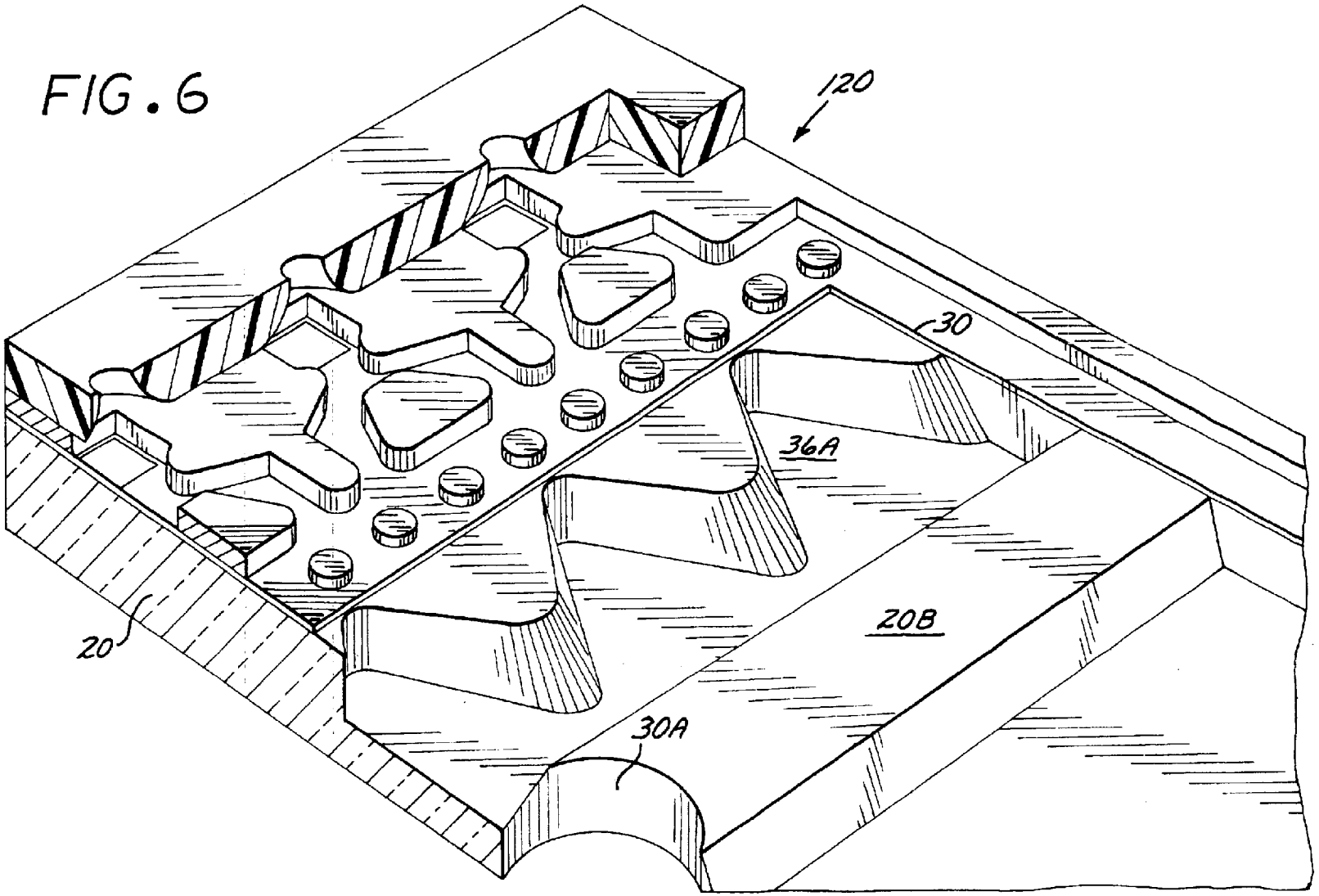
FIG. 6 is a partial fragmentary isometric view of a further alternate embodiment of a fluid ejector structure.

FIG. 6 is a partial fragmentary isometric view of a further alternate embodiment of a printhead structure 120 in accordance with an aspect of the invention. This embodiment is similar to the printhead structure of FIG. 2, but has a difference in the etched trench. A substrate rib structure 20B remains within the trench after etching the trench 30. The rib structure is defined by the mask used for defining the trench. The rib structure provides additional substrate strength, and also reduces the tendency of the barrier layer to thin due to the presence of the trench. The barrier layer can be applied as either a dry film rolled onto the surface of the substrate or as a liquid film spun onto the surface of the substrate. The film, in either case, is then patterned to provide the desired fluidic performance. Upon application of a dry film barrier, the presence of the rib structure provides support for the application roller that allows for less roller deformation and distortion of the barrier near the edges of the trench. Upon application of a liquid film, the presence of the rib structure allows for reduced topography that can cause distortions in the film near the edges of the trench as it is spun on.

Figure 7:
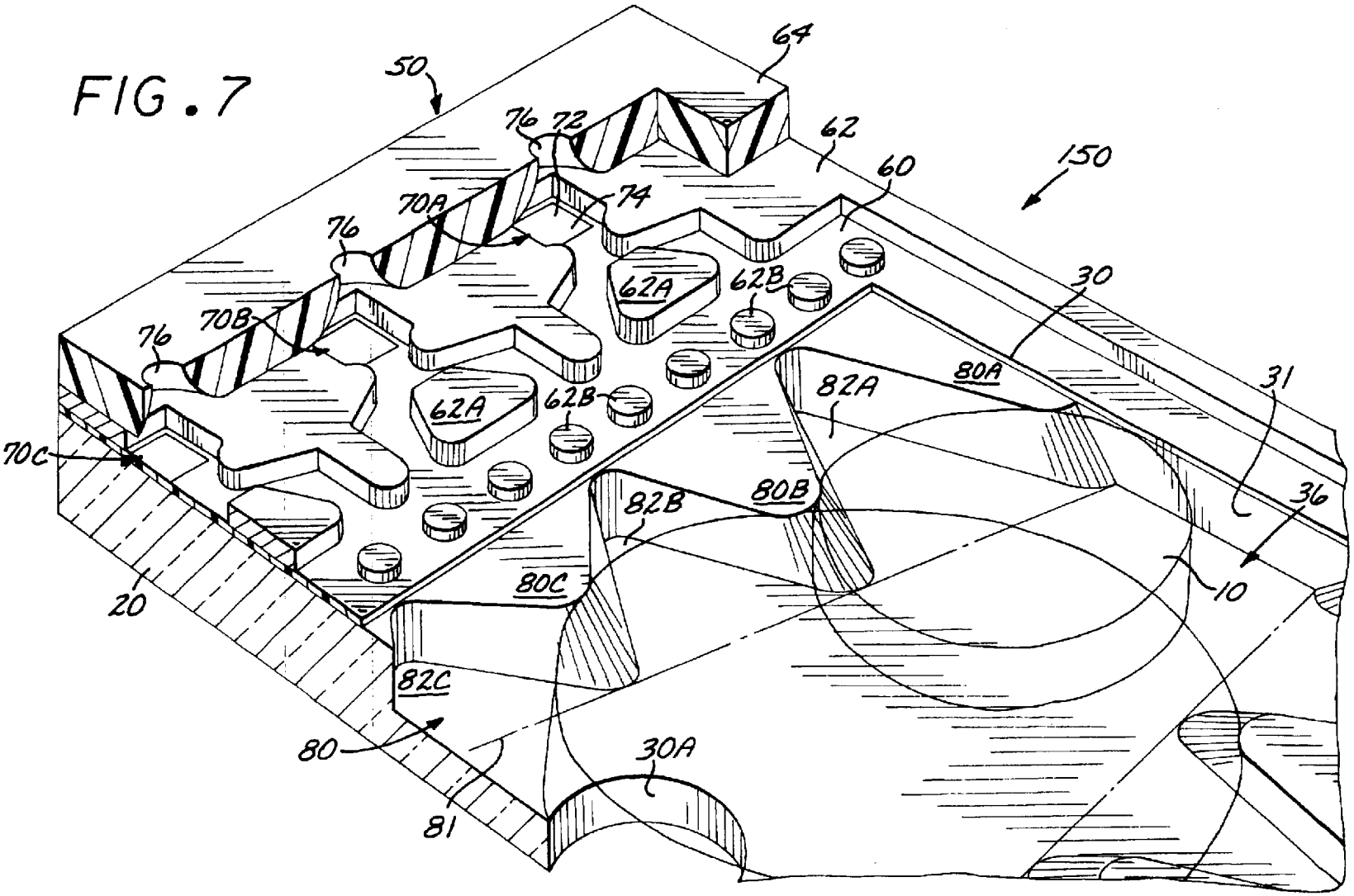
FIG. 7 is a partial fragmentary isometric view of another alternate embodiment of a fluid ejector structure.

FIG. 7 is a partial fragmentary isometric view of a further alternate embodiment of a printhead structure 150 in accordance with an aspect of the invention. This embodiment is similar to that of FIG. 2, but the lengths of the bubble trapping features 80A, 80B, 80C vary. In one embodiment, the feature lengths are longer toward the end of the trench. Thus, feature 80A is longer than features 80B and 80C, and feature 80B is longer than 80C. The tips of the features lie on or along a line which forms an obtuse angle with the end 31 of the trench in this embodiment. The varying length of the features will tend to move an air bubble 10 toward the slot 30A as it grows.

Although the foregoing has been a description and illustration of specific embodiments of the invention, various modifications and changes thereto can be made by persons skilled in the art without departing from the scope and spirit of the invention as defined by the following claims. For example, in another embodiment, the substrate does not include a trench, and the feed slot structure is formed in the substrate between the top and bottom surfaces of the substrate. The features 80 can be formed in a peripheral side wall of the slot structure adjacent the shelf region.

What is claimed is:

1. A fluid ejection device, comprising:

a substrate having a top surface and a bottom surface;

a plurality of fluid drop generators formed on the top surface of the substrate along a shelf region, each including a firing chamber;

a top-side trench formed in the substrate on said top surface, the trench having a trench floor end a peripheral trench side wall formed in the substrate adjacent the shelf region;

a fluid feed slot structure defined in the substrate between the trench floor and the bottom surface; and a plurality of features formed in the trench side wall which create at least one diverging channel directed away from the shelf region.

2. The device of claim 1, wherein the plurality of features are tapered.

3. The device of claim 1, wherein the trench floor is generally parallel to the top surface of the substrate.

4. The device of claim 1, wherein the slot structure comprises a partial slot structure which is formed through a portion of the trench floor.

5. The device of claim 1, wherein the slot structure includes a plurality of spaced slots each formed through a portion of the trench floor, with substrate areas between the partial slots remaining to reduce substrate weakening.

6. The device of claim 1, wherein the trench and said plurality of features are etched in the substrate in an etch process step.

7. The device of claim 6, wherein the trench and said plurality of features are etched by an anisotropic etch process.

8. The device of claim 6, wherein the trench and said plurality of features are etched by an isotropic etch process.

9. The device of claim 1, further including a substrate rib structure within the trench.

10. A fluid ejection device, comprising:

a substrate having a top surface and a bottom surface;

a plurality of thin film layers formed on the top surface of the substrate, at least one of said layers forming a plurality of fluid ejection elements;

a barrier/orifice structure formed over said thin film layers, said structure defining a plurality of fluid ejection chambers, said barrier/orifice structure further defining a nozzle for each fluid ejection chamber;

a top-side trench formed on said top surface, the trench having a trench floor and a peripheral trench side wall formed in the substrate adjacent a top surface shelf region adjacent said fluid election elements;

a fluid feed slot structure defined in the substrate between the trench floor and the bottom surface; and a plurality of tapered slot features formed in the trench side wall which create at least one diverging channel directed away from the shelf region.

11. The device of claim 10, wherein the trench floor is generally parallel to the top surface of the substrate.

12. The device of claim 10, wherein the slot structure comprises a partial slot structure which is formed through a portion of the trench floor.

13. The device of claim 10, wherein the slot structure includes a plurality of spaced slots each formed through a portion of the trench floor, with substrate areas between the partial slots remaining to reduce substrate weakening.

14. The device of claim 10, wherein:

the trench has a lateral trench edge generally transverse to the trench side wall;

the plurality of firing chambers includes firing chambers extending past the lateral trench edge; and the barrier/orifice structure defines a set of barrier reef islands disposed along the shell region, and a bubble management feature defining an acute angle with respect to the shelf region to guide bubbles away from the firing chambers to the trench.

15. The device of claim 10, wherein said plurality of features are of varying length, and wherein the length decreases from a lateral end of the trench toward a middle portion of the slot to guide bubbles in the trench toward the slot.

16. An inkjet printhead, comprising:

a substantially planar substrate having a top surface and a bottom surface;

a thin film structure formed on the top surface and defining a plurality of ink drop generators, each including a firing chamber;

a trench formed in the top surface, the trench having a trench wall and a trench surface recessed below the top surface of the substrate;

an ink feed slot defined in the substrate between the trench surface and the bottom surface; and a tapered slot feature formed in the trench wall to create at least one diverging channel directed away from the trench wall.

17. An inkjet printhead, comprising:

a substrate having a top surface and a bottom surface;

a plurality of thin film layers formed on the top surface of the substrate, at least one of said layers forming a plurality of ink drop generator elements adjacent a shelf region;

a barrier/orifice structure formed over said thin film layers, said structure defining a plurality of ink ejection chambers, said barrier/orifice structure further defining a nozzle for each chamber;

a top-side trench formed in the top surface, the trench having a trench floor and a peripheral trench side wall formed in the substrate adjacent the shelf region;

a fluid feed slot structure defined in the substrate between the trench floor and the bottom surface to allow ink flow from an ink reservoir in fluid communication with the bottom surface; and a plurality of tapered slot features formed in the trench side wall which create one or more diverging channels directed away from the shelf region.

18. A method of fabricating a substrate for a fluid ejection device, comprising:

forming a mask over a top surface of the substrate defining a trench perimeter, the mask including a plurality of mask protrusions substantially along an edge of the trench perimeter, wherein the protrusions protrude toward a center of the mask;

etching a trench in the substrate through the mask, the trench having a trench floor and a trench side wall;

forming slot features in the trench side wall to create a diverging channel directed away from a shelf region defined by the mask protrusions; and forming one or more slots in the substrate between the trench floor and a bottom surface of the substrate.

19. The method of claim 18, wherein etching the trench comprises, using a wet etching process.

20. The method of claim 19, wherein said wet etching process includes:

subjecting the substrate to tetramethyl ammonium hydroxide to anisotropically etch the substrate.

21. The method of claim 20, wherein said forming a mask includes forming a patterned field oxide layer.

22. The method of claim 18, wherein said plurality of mask protrusions have generally square tips or generally trapezoidal tips or generally triangular tips.

23. The method of claim 18, wherein etching the trench comprises using a dry etching process.

24. The method of claim 18, wherein said slot features formed by said etching are tapered features.

25. The method of claim 18, wherein:

said mask protrusions define open corners; and said etching a trench comprises anisotropically etching the substrate.

* * * * *

UNITED STATES PATENT AND TRADEMARK OFFICE

CERTIFICATE OF CORRECTION

PATENT NO. : 6,746,106 B1
DATED : June 8, 2004
INVENTOR(S) : Michael B. Hager

It is certified that error appears in the above-identified patent and that said Letters Patent is hereby corrected as shown below:

Column 5,
Line 41, delete “end” and insert in lieu thereof -- and --;

Column 6,
Line 15, delete “election” and insert in lieu thereof -- ejection --;
Line 37, delete “shell” and insert in lieu thereof -- shelf --.

Signed and Sealed this

First Day of February, 2005

JON W. DUDAS
*Director of the United States Patent and Trademark Office*